US006561842B1

(12) United States Patent
Watanabe et al.

(10) Patent No.: US 6,561,842 B1
(45) Date of Patent: May 13, 2003

(54) MODULAR JACK

(75) Inventors: Toru Watanabe, Tokyo (JP); Akio Suzuki, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 10/167,496

(22) Filed: Jun. 13, 2002

(30) Foreign Application Priority Data

Jun. 20, 2001 (JP) ..... 2001-185966

(51) Int. Cl.[7] ..... H01R 3/00
(52) U.S. Cl. ..... 439/490
(58) Field of Search ..... 439/490, 676

(56) References Cited

U.S. PATENT DOCUMENTS 5,700,157 A * 12/1997 Chung ..... 439/490
5,704,802 A * 1/1998 Loudermilk ..... 439/490
5,876,240 A * 3/1999 Derstine et al. ..... 340/815.47
6,319,062 B1 * 11/2001 Ma et al. ..... 439/490

* cited by examiner

*Primary Examiner*—Lynn D. Feild
*Assistant Examiner*—Phuong Dinh
(74) *Attorney, Agent, or Firm*—Kanesaka & Takeuchi

(57) ABSTRACT

A modular jack (21) comprises a housing (22), at least one fixing hole (31 and 32) provided in the housing and having a first compartment (33 and 34) and a pair of second compartments (35, 35', 36, and 36') extending rearwardly from the first compartment and at least one light emitting diode (LED) (24 and 25) having a display portion 47 and 48) accommodated in the first compartment and a pair of legs (49, 49', 50, and 50') accommodated in the second compartments. The modular jack further comprises a pair of leads (54) connected to the legs and a pair of connection terminals (53) for connecting the legs and leads so that the LED is connected to a circuit board through the leads.

7 Claims, 3 Drawing Sheets

MODULAR JACK

BACKGROUND OF THE INVENTION

1. Field of the Invention

The present invention relates to a modular jack that receives a modular plug and has light emitting diodes (LEDs).

2. Description of the Related Art

A modular jack having light emitting diodes is generally used for telephone equipment or local area network (LAN). Such a modular jack is disclosed, for example, in U.S. Pat. No. 5,700,157.

As shown in FIG. 4, the modular jack 1 disclosed in U.S. Pat. No. 5,7000,157, comprises a housing 3 having a cavity 2 in a front face thereof for a modular plug (not shown), a predetermined number of terminals 4 arranged in the cavity, a fixing hole 5 provided in a peripheral wall of the housing 3, an LED 6 fitted in the fixing hole 5, and an LED connection terminal 7 buried in a rear side of the fixing hole 5.

The LED 6 comprises a thin rectangular display portion 8 and a pair of bar-shaped legs 9 extending rearwardly from the display portion 8. The LED 6 is installed in the fixing hole horizontally such that a front end 10 of the display portion 8 projects from the housing 3. The LED connection terminal 7 comprises a clamp 11 for holding the leg 9, which contacts with side faces 12 of the leg 9. The LED connection terminal 7 further comprises a pair of connection pieces 14 extending downwardly from a rear part of the clamp 11. A lower portion 15 of the connection piece 14 projects from the housing 3 and is connected to a circuit board (not shown).

In order to fix the LED 6 to the housing 3, the LED 6 is press-fitted to the fixing hole 5 from a front side of the housing 3 so that the legs 9 are held in the clamp 11. To remove the LED 6, it is pulled out by holding the front end 10 of the display portion 8 by a tool such as a plier.

However, the position of the modular jack 1 is restricted to such a position that the LED connection terminal 7 is provided, because the modular jack 1 is connected to the circuit board through the LED connection terminal 7 buried in the housing 3. Otherwise, the position of the circuit board is required to be changed to an area where the modular jack 1 is placed. Also, it is difficult to connect the modular jack 1 to a circuit board because the LED connection terminal 7 is fixed to the housing, resulting in the low work efficiency. The complicated structure of the LED connection terminal 7 makes it difficult to reduce the manufacturing cost. In addition, it requires an extensive design change of the LED connection terminal 7 to change the horizontal arrangement of the LED 6 to vertical arrangement, which decreases the freedom in arrangement of the LED.

Moreover, a projection part is formed on side face 12 of the leg 9 during manufacturing so that there is the risk that connection between the leg 9 and the clamp 11 is made through the projection. Consequently, the connection therebetween is not stable, reducing the electrical reliability.

SUMMARY OF THE INVENTION

Accordingly, it is an object of the invention to provide a modular jack capable of increasing the arrangement freedom of modular jack and the LED, reducing the manufacturing cost, and improving the reliability.

A modular jack according to the invention comprises at least one light emitting diode (LED) that is connected to a predetermined circuit board through a lead.

Preferably, the connection between the LED and the lead is made by a connection terminal. The connection terminal may be a crimping terminal, which is crimped on the lead wire.

The modular jack comprises a housing having at least one LED contact portion for preventing rearward movement of the LED and terminal contact portions for preventing forward movement of the connection terminal.

With such a structure it is possible to improve the arrangement freedom of the modular jack and the LED, reduce the manufacturing cost, and improve an electrical reliability.

DESCRIPTION OF THE PREFERRED EMBODYMENT

Embodiments of the invention will now be described with reference to the accompanying drawings.

Figure 1:
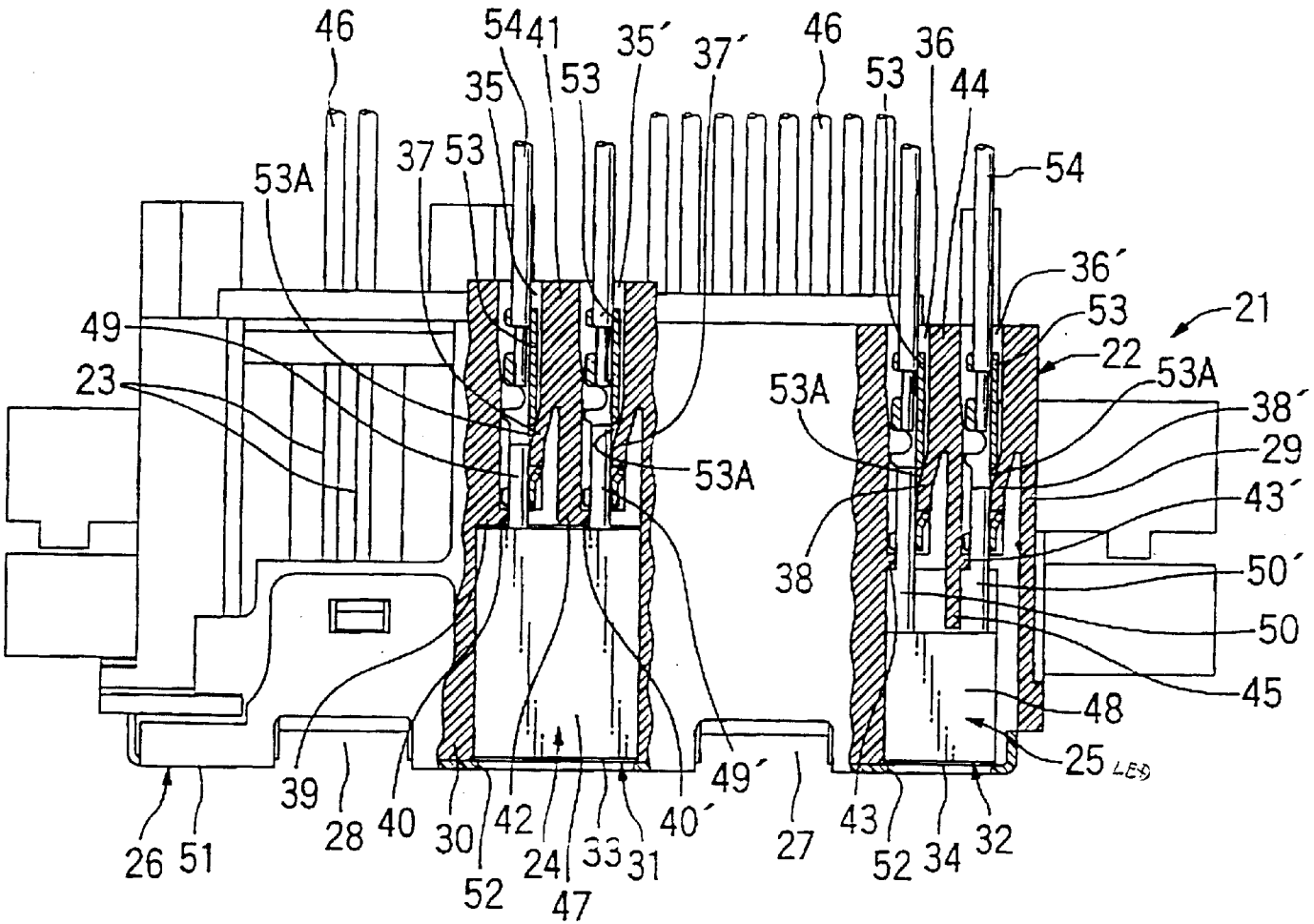
FIG. 1 is a top plan view, partially in section, of a modular jack according to an embodiment of the invention.
Figure 2:
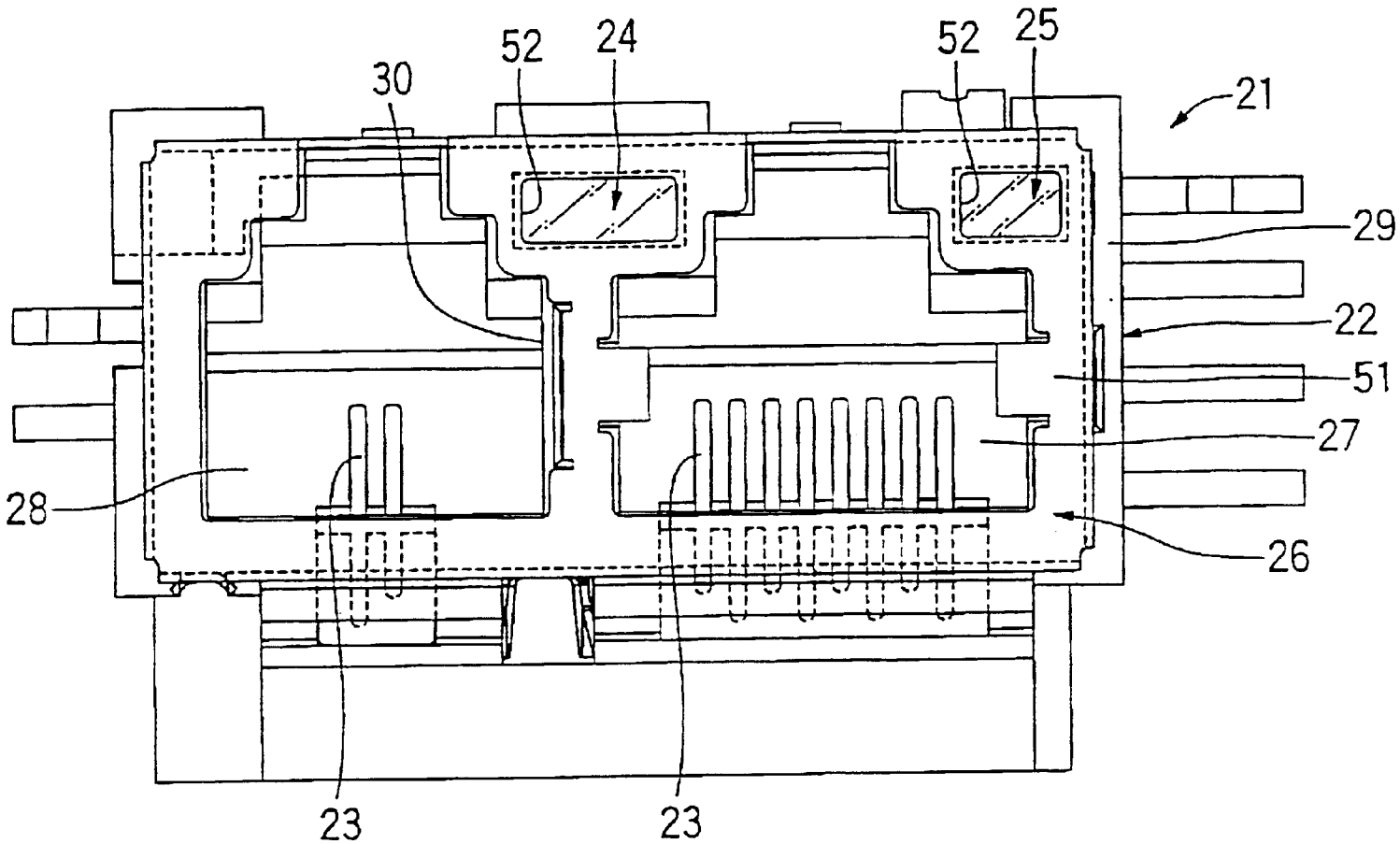
FIG. 2 is a front view of the modular jack of FIG. 1.

FIGS. 1 and 2 show a modular jack 21 according to an embodiment of the invention. The modular jack 21 comprises a housing 22 made of an insulative material, a plurality of terminals 23 provided in the housing 22, a pair of light emitting diodes (LED) 24 and 25 which are visible from the front side of the housing 22, and a shield plate 16 provided outside the housing 22.

The housing 22 is provided with a predetermined number (two in the figures) of cavities 27 and 28 on the front side. A modular plug (not shown) for LAN is inserted into the cavity 27 and a modular plug for MODEM (not shown) is inserted into the cavity 28. A side wall 29 of the housing 22 is provided adjacent to the cavity 27, and a partition wall 30 is provided between the cavities 27 and 28. Fixing holes 31 and 32 are provided at upper sections of the side wall 29 and the partition wall 30, respectively. The fixing hole 31 is composed of square-pillar-shaped compartments 33 for accommodating LEDs and long and narrow compartments 35 and 35' for accommodating connection terminals, which extend rearwardly from the compartment 33 in parallel with each other. The fixing hole 32 is composed of square-pillar-shaped compartments 34 for accommodating LEDs and long and narrow compartments 36 and 36' for accommodating connection terminals, which extend rearwardly from the compartment 34 in parallel with each other. Cantilevered engaging pieces 37, 37', 38, and 38' are provided in the compartments 35, 35', 36, and 36', respectively. The cantilevered engaging pieces 37, 37', 38, and 38' are flexible in the horizontal direction. A first terminal contact portion 40 is provided at a stepped portion 39 between the compartments 33 and 35 and projects in the horizontal direction. A second terminal contact portion 40' is provided at a front end portion 42 of a partition wall 41 between the compartments 35 and 35' and projects in the horizontal direction. A first terminal contact portion 43 is provided at the front end portion of the compartment 36 and projects in the horizontal direction. A second terminal contact portion 43' is provided at a position on a partition wall 44 between the compartments 36 and 36' corresponding to the position of the first terminal contact portion 43 and projects in the horizontal direction. A front end portion 45 of the partition wall 44 projects into the compartment 34.

A predetermined number of the terminals 23 are arranged in each of the cavities 27 and 28 in parallel with each other (eight terminals in the cavity 27 and two terminals in the cavity 28 in the figures). A rear end of each terminal 23 is connected to an end of a lead 46. The other end of the lead 46 is connected to another terminal and disposed in a connector (not shown). Each terminal 23 may be connected to a circuit board, which is provided at a position far from the modular jack 21, through the connector.

Each LED 24 or 25 comprises a display portion 47 or 48, which is enagageable with the compartment 33 or 34, and a pair of legs 49 and 49', or 50 and 50', which are provided at a rear end of the display portion 47 or 48. The legs 49, 49', 50, and 50' are bar-shaped plates and inserted into the compartments 35, 35', 36, and 36', respectively. A tie bar (not shown) is provided on a side portion of each leg. One of the LEDs 24 is, for example, green and lights up when the modular jack 21 and the modular plug (not shown) are electrically connected, and the other LED 25 is, for example, yellow and lights up when data is transmitted between the modular jack 21 and the modular plug.

The shield plate 26 covers the housing 22 except for at least the cavities 27 and 28 provided on the front side of the housing 22. A front face 51 of the shield plate 26 has windows 52 at positions corresponding to the positions of the display portions 47 and 48. The windows 52 are smaller than front faces of the display portions 47 and 48. As sated above, since the shield plate 26 is provided such that it covers a peripheral portion of the front face of the display portions 47 and 48, the LEDs 24 and 25 do not fall off. The shield plate 26 may be connected to a panel, if necessary.

How to mount the LED 24 on the housing 22 is described below.

When the LED 24 is inserted into the fixing hole 31 from the front side of the housing 22, the rear end of the display portion 47 is contacted to the stepped portion 39 and the front end portion 42 of the partition wall 41, and the display portion 47 is accommodated in the compartment 33. Concurrently, the legs 49 and 49' are inserted with play into the compartments 35 and 35', respectively. Then, when leads 54 having a crimp terminals 53 at the front ends as connection terminals are inserted into the compartments 35 and 35' from the rear side of the housing 22, the crimp terminals 53 hold the legs 49 and 49' from upper and lower sides, connecting the leads 54 to the LED 24 via the crimp terminals 53. At this time, front ends of the crimp terminals 53 are brought into contact with the first and second terminal contact portions 40 and 40', and the engaging pieces 37 and 37' engage with engaging holes 53A provided on the side surfaces of the crimp terminals 53.

In the same way, when the LED 25 is fitted into the fixing hole 32 from the front side of the housing 22, the rear end of the display portion 48 is brought into contact with the front end portion 45 of the partition wall 44, and the display portion 48 is accommodated in the compartment 34. Concurrently, the legs 50 and 50' are inserted with play into the compartments 36 and 36', respectively. Then, when leads 54 having a crimp terminals 53 at the front end as connection terminals are inserted into the compartments 36 and 36' from the rear side of the housing 22, the crimp terminals 53 hold the legs 50 and 50' from upper and lower sides, connecting the leads 54 to the LED 25 via the crimp terminals 53. At this time, the front ends of the crimp terminals 53 are brought into contact with the first and second terminal contact portions 43 and 43', and the engaging pieces 38 and 38' engage with engaging holes 53A provided on the side surfaces of the crimp terminals 53.

Thus, the reaward movement of the LEDs 24 an 25 is prevented by the fact that the rear ends of the display portions 47 and 48 abut on the stepped portion 39 and the front end portion 42 or 45 of the partition wall 41 or 44. Also, the forward movement of leads 54 is prevented by the fact that the front end portions of the crimp terminals 53 abut on the first and second contact portions 40 and 40', or the first and second contact portions 43 and 43'. Consequently, the LEDs 24 and 25 are firmly held in the housing 22. There are spaces between the crimp terminals 53 and inner walls of the compartments 35, 35', 36, and 36' because the crimp terminals 53 are inserted with some play into the compartments 35, 35', 36, and 36'. Accordingly, even if the modular jack 21 receives a shock, the crimp terminals 53 absorb the shake and shock in the compartments 35, 35', 36, and 36' so that the shock is not applied to the connection section between the crimp terminals 53 and the legs 49 , 49', 50, and 50'. Consequently, the connections between them are secured. Also, the other end of each of the leads 54 is connected to a terminal and arranged in a connector (not shown). Each crimp terminal 53 may be connected to a circuit board, which is provided at a position far from the modular jack 21, through the connector. Consequently, the position of the modular jack 21 is not restricted.

The LEDs 24 and 25 are electrically connected to the leads 54 and held in the housing 22 by simply fitting the LEDs 24 and 25 into the compartments 33 and 34 and inserting the leads 54 into the compartments 35, 35', 36, and 36', thus simplifying the assembly work for the LEDs 24 and 25 and reducing the manufacturing cost. No processing work for the housing 22 is required except providing the fixing holes 31 and 32, thus providing the simplified structure and space saving in the housing and making it easy to change the arrangement and direction of the LEDs 24 and 25.

Since the legs 49, 49', 50, and 50' are in contact with the crimping terminal 53 at the upper and lower sides thereof but not the projection, the LEDs 24 and 25 are stably connected to the leads 54, and the electrical characteristics are improved. In addition, since the LEDs 24 and 25 are connected to the leads 54 through the crimp terminals 53, the size of the leads 54 is freely changed.

The LEDs 24 and 25 may be connected to the leads 54 by other methods such as press-connection, insulation piercing or soldering instead of crimping. In such a case, the LEDs 24 and 25 are fixed to the housing 22 after connection with the leads 54.

Figure 3:
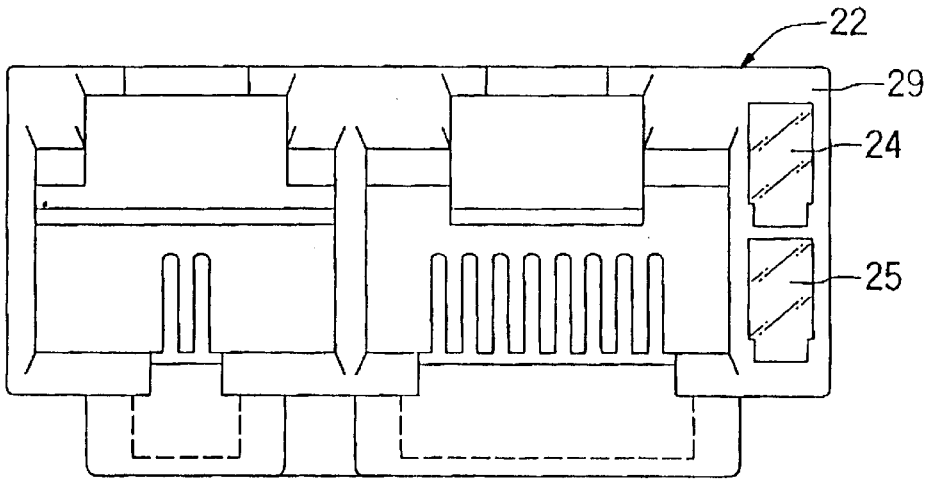
FIG. 3 is a front view of a modular jack according to another embodiment of the invention.
Figure 4:
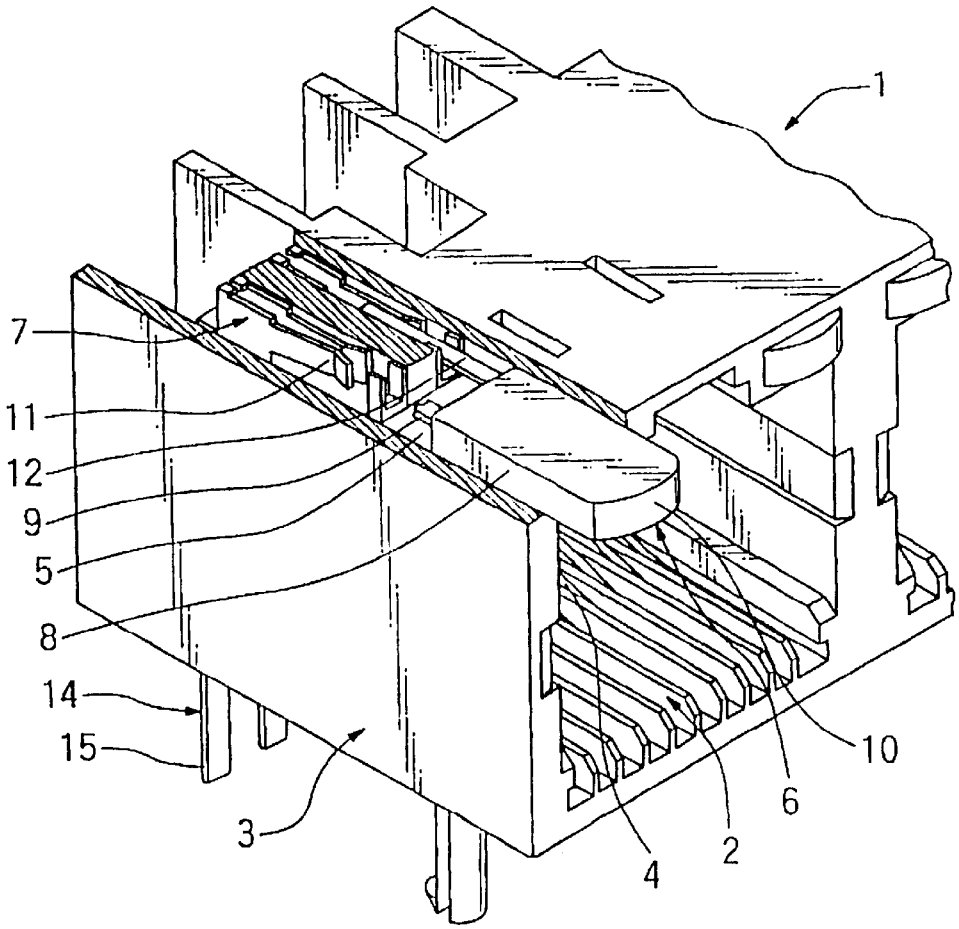
FIG. 4 (PRIOR ART)
FIG. 4 is a perspective view, partially in section, of a conventional modular jack.

As shown in FIG. 3, the LEDs 24 and 25 may be vertically placed in the side wall 29 of the housing 22.

The LEDs 24 and 25 may be held in the housing 22 by press-fitting the display portions 47 and 48 into the compartments 33 and 34. The LEDs 24 and 25 may be the same type of LED.

The number of the LEDs 24 and 25 or cavities 27 and 28 may be freely determined. The shield plate 26 may cover other areas than that described above or may be omitted completely.

Since the LEDs are connected to a circuit board through the leads, the modular jack can be freely placed at any position without restriction by the connection condition of the LEDs.

What is claimed is:

1. A modular jack comprising:

housing;

at least one fixing hole provided in said housing and having a first compartment and a pair of second compartments extending rearwardly from said first compartment;

at least one light emitting diode (LED) having a display portion accommodated in said first compartment and a pair of legs accommodated in said second compartments;

a pair of leads, each having a first end connected to corresponding one of said legs of said LED and a second end connected to a circuit board, wherein lengths of said leads are changeable so that said modular jack is connected to said circuit board provided at a position far from said modular jack through said leads; and a pair of connection terminals provided between said LED and said leads for connecting said legs of said LED and said first ends of said leads.

2. The modular jack according to claim 1, wherein said housing comprises at least one LED contact portion for preventing rearward movement of said LED, and a plurality of terminal contact portions for preventing forward movement of said connection terminals.

3. The modular jack according to claim 1, which further comprises a shield plate provided outside said housing and having a window at a position corresponding to a position of a front face of said LED, said window being smaller than said front face of said LED.

4. The modular jack according to claim 2, which further comprises a shield plate provided outside said housing and having a window at a position corresponding to a position of a front face of said LED, said window being smaller than said front face of said LED.

5. The modular jack according to one of claims 1–4, said legs are held by said connection terminals.

6. The modular jack according to one of claims 1–4, wherein said LEDs are arranged horizontally on an upper portion of a side wall of said housing.

7. The modular jack according to one of claims 1–4, wherein said LEDs are arranged vertically on a side wall of said housing.

* * * * *